United States Patent [19]

Devillard

[11] 4,164,819

[45] Aug. 21, 1979

[54] PAINT DRYING OVEN

[75] Inventor: Roger Devillard, Paris, France

[73] Assignee: Heurtey Metallurgie, Paris, France

[21] Appl. No.: 847,620

[22] Filed: Nov. 1, 1977

[30] Foreign Application Priority Data

Nov. 5, 1976 [FR] France ..... 76 33392

[51] Int. Cl.[2] ..... F26B 21/06

[52] U.S. Cl. ..... 34/72; 34/32; 34/78

[58] Field of Search ..... 34/72, 77, 78, 79, 32, 34/44, 47, 50; 23/277 C

[56] References Cited

U.S. PATENT DOCUMENTS

| | | | |
|---|---|---|---|
| 2,795,054 | 6/1957 | Bowen | 34/72 |
| 3,437,321 | 4/1969 | Wilkinson | 34/79 |
| 3,909,953 | 10/1975 | Hemsath et al. | 34/72 X |
| 3,917,444 | 11/1975 | Carthew | 34/79 X |
| 4,073,063 | 2/1978 | Gutjahr | 34/72 X |
| 4,087,923 | 5/1978 | Wilt, Jr. et al. | 34/72 |

FOREIGN PATENT DOCUMENTS

| | | | |
|---|---|---|---|
| 2305704 | 10/1976 | France . | |
| 450065 | 5/1975 | U.S.S.R. | 34/72 |

*Primary Examiner*—James Kee Chi

*Attorney, Agent, or Firm*—Wenderoth, Lind & Ponack

[57] ABSTRACT

In an oven for drying paints on metal strips or bands travelling continuously therethrough, several incinerators are mounted directly on the oven, and an external incinerator is also provided for incinerating the gases released during the drying operation, each incinerator receiving the same mixture to be incinerated.

6 Claims, 2 Drawing Figures

PAINT DRYING OVEN

BACKGROUND OF THE INVENTION

The present invention relates to improvements in or relating to ovens intented for drying paints on continuously travelling metal bands, strips or tapes.

It is known that the drying of paints used in such processes is attended, according to the specific nature of the paints, by the release of water steam or organic solvent vapours. In this last instance, highly combustible products are involved which must be diluted sufficiently to prevent their ignition within the oven enclosure. This dilution is obtained by using air in such proportions as to set the mixture well beyond the inflammability limits.

Therefore, in hitherto known paint drying ovens one portion of the gases contained in the oven is discharged permanently and the organic solvents are burned in an incineration oven meeting a twofold requirement: on the one hand, eliminating any possibility of pollution by these organic substances, and on the other hand regenerating the heat contained therein in order to improve the energy balance of the drying plant.

Nowadays, ovens of relatively large size, comprising very complicated gas circulation systems, are used for the continuous drying of paints deposited on bands or strips. A typical example of an oven of this type is illustrated diagrammatically in FIG. 1 of the attached drawing.

In FIG. 1 the reference numeral 10 designates the drying oven proper. This oven is divided into several sections A, B, C and D in order to obtain different heating rates for each phase of the paint drying cycle. In fact, at the beginning of this cycle the primary effect is to substantially evaporate the organic solvents contained in the paints. Then, the paints are polymerized, and finally hardened. As a result, very variable solvent concentrations are recorded along the path followed by the band travelling continuously through the oven. As clearly shown in the drawing, each section of the oven illustrated comprises a gas blowing device 12 so that the gas impinges against the continuously travelling band 14 and adequate heat exchanges take place by convection. The gas thus blown against the band 14 is taken from the surrounding gas in chamber 10' of the oven and includes fresh air mixed with hot gases (circulating along the circuit shown in dash lines) from the incinerator 16 and from the smokes produced in a make-up burner such as 18 for keeping the mixture temperature at a value substantially within the range of 150° to 450° C.

At a predetermined point P of the evaporation area of oven 10 a certain output of the gaseous mixture is removed from the oven, the solvent content of this mixture resulting from the solvent evaporation taking place during and along the drying cycle. This mixture circulating along the path shown in dash and dot lines is directed to the incineration oven 16 in which the solvents are burned by virtue of the additional heat resulting from a preferably gaseous make-up fuel G.

In this known arrangement, the gas temperature at the outlet of the incineration oven is of the order of 750° C. These gases are directed on the one hand towards the oven sections A, B, C, and D (along the dash-line circuit) in which they are mixed as mentioned hereinabove with the surrounding gas before being blown against the metal band, and on the other hand towards heat regenerating means 20, for example in order to produce steam or hot water, for heating thermal fluids, etc.., before being discharged to the atomsphere via a conduit 22. The fraction of the gases thus rejected to the atmosphere is compensated by the ingress of fresh air into the oven, such as shown at the right side thereof in FIG. 1.

In a modified construction, not shown in the drawing, of this type of known arrangement, the gases recycled to the various sections of the drying oven are derived not directly from the incinerator 16 but consist of air heated by means of a heater interposed between the incinerator 16 and the heat regenerating means 20.

The capacities of incinerators of the type now widely used range from about 200 to about 500 liters of solvent per hour. However, it is contemplated for future plants to improve these capacities up to and even beyond 1,000 liters/hour with a corresponding air output of the order of 70,000 $Nm^3/h$. Consequently, the incineration ovens incorporated in plants of this type will be extremely bulky. Besides, the pipes connecting the incineration oven to the various sections of the drying oven will convey gases at temperatures of the order of 750° C., so that efficient lagging must be used, which means an excessive increase in costs and dimensions.

On the other hand, due to the considerable mass of solvents to be evaporated, it is very important to provide means for equalizing their concentration along the oven in order to minimize the dilution outputs necessary for keeping the mixtures below their inflammability limits.

Moreover, these known plants are also objectionable in that the drying oven exploitation is subordinate to the incineration requirements, on the one hand, and to the energy recovery or recuperation, before rejecting the gases to the atmosphere, on the other hand.

SUMMARY OF THE INVENTION

Now it is the essential object of the present invention to provide a drying oven capable of overcoming most, if not all, of the above-mentioned shortcomings by providing an arrangement such that different relationships are provided between the drying of paints, the dilution of solvents, the incineration and the heat recuperation.

Consequently, this invention is directed to provide an improved oven arrangement for drying paints on continuously travelling metal bands, strips or tapes, the oven according to the present invention comprising a plurality of heating areas in order to provide different heating rates during each phase of the heating cycle, and wherein one fraction of the gases filling the oven enclosure is discharged permanently and is burned, this oven being characterized essentially in that it comprises on the one hand at least one incinerator mounted directly on the oven and adapted to deliver the smokes produced therein directly to one or several drying areas, and on the other hand at least one final external incinerator adapted to incinerate the gases discharged from the drying oven, each incinerator receiving the same mixture to be incinerated.

According to another feature characterizing this invention, each one of the above-mentioned oven areas may be either equipped with a separate incinerator, or supplied from an incinerator common to several such areas.

According to a further feature characterizing this invention, one or several oven areas may be provided with a make-up burner adapted to regulate the blowing temperature in the area concerned.

BRIEF DESCRIPTION OF THE DRAWINGS

Other objects, features and advantages of the present invention will be apparent from the following detailed description, taken with reference to the accompanying drawings, wherein.

DETAILED DESCRIPTION OF THE INVENTION

Figure 1:
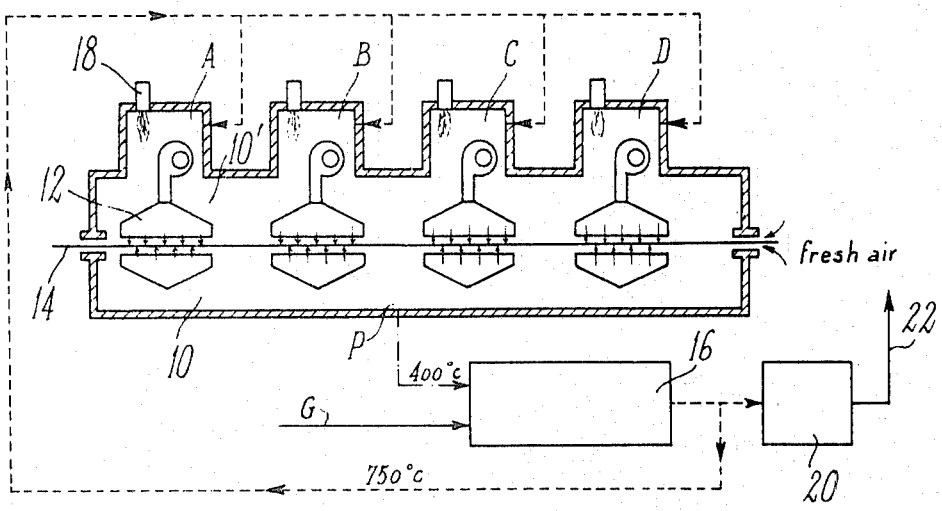
FIG. 1 PRIOR ART
FIG. 1 is a schematic diagram illustrating a known paint drying oven.
Figure 2:
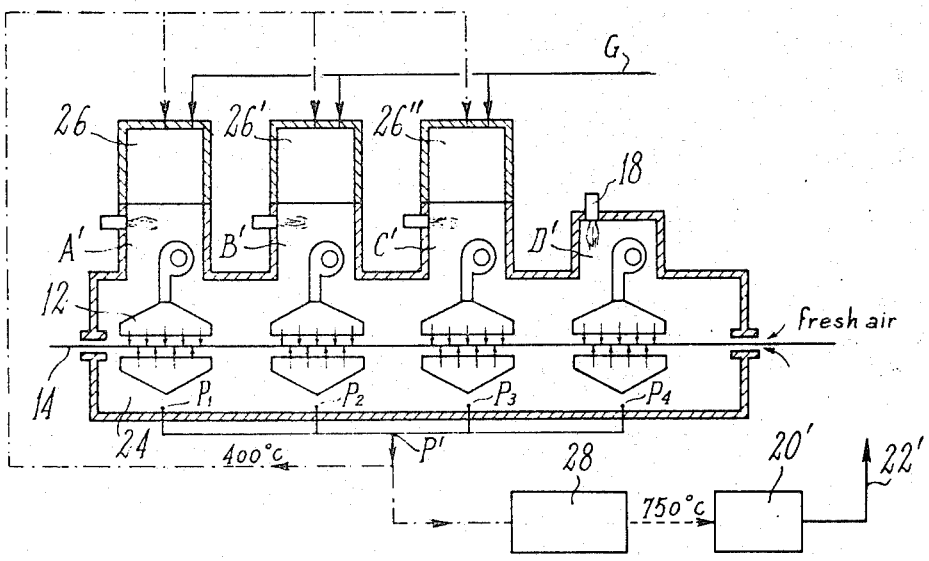
FIG. 2 is a schematic diagram illustrating a paint drying oven according to the invention.

In FIG. 2, the oven according to the instant invention is designated in general by the reference numeral 24. In this Figure the pipings for circulating the various gases are designated by the same numerals or letters, and the same dash lines and dot-and-dash lines as in FIG. 1. The dash-and-dot lines show the path followed by the solvent-rich mixture issuing from the oven after the incineration, and the dot lines illustrate the gas circulation after the regeneration.

The oven 24 is also divided into several heating areas which in this example are four in number and are denoted A', B', C' and D'. As in known oven arrangements mentioned in the foregoing with reference to FIG. 1, each area includes means 12 for blowing gas against the metal band or strips 14 travelling continuously through the oven.

According to this invention, the oven comprises one or a plurality of incinerators mounted directly on the oven in the portion thereof where the solvents are evaporated. In the embodiment illustrated, three such incinerators 26, 26', 26'', connected directly to the oven at the level of areas A', B', C', respectively, are provided, such incinerators performing the combustion of the solvents with the assistance of the heat resulting from the combustion of a gaseous fuel. These areas of the drying oven are supplied with hot gas from the incinerators, and in such areas the combustion gases are mixed immediately with the re-circulated oven gases before being blown against the painted metal strip. The fraction of the gaseous mixture within the oven which is delivered to incinerators 26, 26' and 26'' is taken from different points or locations $P_1$, $P_2$, $P_3$ and $P_4$ disposed along the oven, i.e. where the solvents are released in different manners. In fact, the bulk of this solvent release takes place in the first areas of the oven where the organic solvent are effectively evaporated, before the paints are polymerized and hardened. The gases from these various gaseous release points $P_1$, $P_2$, $P_3$ and $P_4$ are collected at a point P' to constitute a single mixture the solvent content of which does not exceed the inflammability limit.

With this arrangement it is possible on the one hand to reduce the amount of dilution air necessary for adjusting the solvent concentration to the value set by safety regulations, and on the other hand to deliver a uniform gaseous mixture to the incinerators 26, 26' and 26''.

The other or residual fraction of the gaseous mixture taken at $P_1$, $P_2$, $P_3$ and $P_4$, which is compensated for by the volume of cool or fresh air sucked into the oven, is directed towards a final external incinerator 28 of which the smokes, after a preliminary heat recovery in a recuperator 20', are discharged into the surrounding atmosphere via a chimney 22'.

From the above description it appears clearly that in the paint drying oven according to this invention the elimination, by means of incinerator 28, of any atmospheric pollution by solvents, is a function separate from the drying of paints in the oven.

In a plant equipped with an oven according to this invention, the utilization of the recovery or recuperation heat is not subordinate to the conditions of operation of the oven. Moreover, the oven incinerators 26, 26' and 26'', and the final incineration oven 28 may operate at different temperatures without producing any interaction between the production of the drying oven and the external pollution. Finally, with the present invention, the pipes are not subjected to high temperatures, since the only gas circulation outside the oven (in the dash-and-dot line circuit for the high-solvent mixture) takes place at a relatively low temperature (400° C. in this example) and therefore under reduced volume conditions.

Of course, this invention should not be construed as being strictly limited by the specific form of the embodiment described and illustrated herein, since various modifications and changes may be made thereto without departing from the basic principles of the invention as set forth in the appended claims. Thus, each oven area or section may be either equipped with a separate incinerator (in the case of areas A', B' and C'), or supplied from an incinerator common to several areas or sections. One or more areas of the oven may also be equipped, if desired, with only one make-up burner 18' (area D') for regulating the blowing temperature in this area.

Finally, the oven incinerators 26, 26', 26'' and the final incineration oven 28 may operate at different output temperatures.

What is claimed as new is:

1. An apparatus for drying paint on metal strips, said apparatus comprising:

an elongated oven having at opposite ends thereof inlet and outlet openings for the entrance and discharge, respectively, of a painted metal strip continuously moving through said oven;

the interior of said oven, between said opposite ends thereof, including plural heating sections through the volumes of which said painted metal strip sequentially passes;

each said heating section having therein a separate blower means for directing a gaseous mixture within the said volume of the respective said heating section against said painted metal strip, and for thereby drying said painted metal strip and evaporating solvents from the paint, whereby said solvents are released in gaseous form into said gaseous mixture in said volume;

means for withdrawing from said interior of said oven a portion of the gaseous mixture therein, including said gaseous solvents;

means for passing a first quantity of said withdrawn gaseous mixture, without any preliminary incineration thereof, directly to at least one first incinerator means directly mounted on said oven for thereby incinerating said gaseous solvents of said first quantity to form combustion gas, the discharge of said first incinerator means being in direct communication with at least one of said heating sections, to thereby discharge said combustion gas directly into the said volumes thereof, such that said gaseous mixture directed by the said blower means thereof includes said combustion gas;

means for passing a second quantity of said withdrawn gaseous mixture directly to a second incinerator means, located separate from and external of said oven, for thereby incinerating said gaseous solvents of said second quantity, whereafter said second quantity may be discharged to the atmosphere; and means associated with said oven for introducing into said interior thereof a quantity of air to compensate for said second quantity discharged to the atmosphere.

2. An apparatus as claimed in claim 1, comprising a plurality of separate said first incinerator means, one each of said first incinerator means being directly mounted on and in communication with a separate one of said heating sections.

3. An apparatus as claimed in claim 1, wherein said first incinerator means is directly mounted on and in communication with plural of said heating sections.

4. An apparatus as claimed in claim 1, wherein at least one of said heating sections has therein a make-up burner for regulating the temperature of the said gaseous mixture therein.

5. An apparatus as claimed in claim 1, wherein said first and second incinerator means operate at different incineration temperatures.

6. An apparatus as claimed in claim 1, wherein said withdrawing means comprises means for discharging gaseous mixtures from plural of said heating sections and then mixing said gaseous mixtures to form a single combined mixture.

* * * * *